US005906415A

United States Patent [19]

Mocur

[11] Patent Number: 5,906,415

[45] Date of Patent: May 25, 1999

[54] WHEELCHAIR AMPUTEE LEG SUPPORT

[76] Inventor: Paul Mocur, 45685 Greenridge Dr., Northville, Mich. 48167

[21] Appl. No.: 09/032,915

[22] Filed: Mar. 2, 1998

[51] Int. Cl.[6] ..... A47C 7/50

[52] U.S. Cl. ..... 297/423.3; 297/423.32; 297/423.33; 5/624; 5/648

[58] Field of Search ..... 297/423.3, 423.31, 297/466, 423.32, 423.33, 423.23, 423.24; 5/624, 650, 648

[56] References Cited

U.S. PATENT DOCUMENTS

| | | | |
|---|---|---|---|
| 440,610 | 11/1890 | Elbreg | 297/423.31 X |
| 1,053,214 | 2/1913 | Poll | 297/423.32 X |
| 2,278,078 | 3/1942 | Kahn | 297/423.32 |
| 2,591,911 | 4/1952 | Block | 297/423.32 X |
| 2,633,896 | 4/1953 | Thompson | 297/423.32 X |
| 5,306,074 | 4/1994 | Mocur | 297/423.31 |

FOREIGN PATENT DOCUMENTS

| | | | |
|---|---|---|---|
| 3687 | 7/1883 | United Kingdom | 297/423.32 |
| 1583906 | 2/1981 | United Kingdom | 297/423.32 |

*Primary Examiner*—Laurie K. Cranmer
*Attorney, Agent, or Firm*—Charles W. Chandler

[57] ABSTRACT

Wheelchairs can be provided with special seats having hinged connections with leg supports locatable in proximity to the seat front edge to provide resting surfaces for amputated legs of disabled persons while sitting in the wheelchair. Each leg support is attached to the seat front edge so as to be swingable between a raised position aligned with the seat, a lowered vertical position extending downwardly from the seat front edge, and an intermediate position extending angularly downwardly from the general plane of the seat. An adjustment mechanism is provided for varying the angle of the leg support in the intermediate position, to achieve a condition most comfortable for a range of users.

8 Claims, 3 Drawing Sheets

WHEELCHAIR AMPUTEE LEG SUPPORT

BACKGROUND AND SUMMARY OF THE INVENTION

This invention relates to wheelchairs, and particularly to an amputee leg support installable on a wheelchair to support the amputated leg of a disabled person seated in the wheelchair. The amputee leg support is constructed so that it can have two different adjusted positions on the wheelchair, according to the position most comfortable for the user.

My U.S. Pat. No. 5,306,074, issued on Apr. 26, 1994, discloses a wheelchair having a seat equipped with a support for supporting the leg of a person whose leg has been amputated at or below the knee. The leg support provides a resting surface for the amputated leg, i.e. the upper portion of the leg remaining after the amputation operation.

The apparatus disclosed in my U.S. Pat. No. , 5,306,074 includes a leg support hinged to the front edge of the wheelchair seat, whereby the leg support can be manually swung between a raised position extending horizontally in front of the seat and a lowered position extending vertically downwardly from the seat. The leg support typically has a length of about eleven inches, so that when the leg support is in its raised horizontal position it presents an obstacle to a person getting in or out of the wheelchair. By moving the leg support to its lowered position the leg support represents less of an obstacle; the person can get in or out of the wheelchair without difficulty.

The present invention relates to an improvement to the wheelchair attachment disclosed in the above-noted U.S. Pat. No. 5,306,074. In the present invention, the leg support is constructed and mounted so that it can be swung to a raised horizontal position, a lowered vertical position extending downwardly from the front edge of the wheelchair seat, or an intermediate position acutely angled to the seat.

The intermediate position of the leg support gives the user an alternate position that might prove more comfortable to certain persons than the horizontal prone position disclosed in my U.S. Pat. No. 5,306,074. At the same time, the present invention retains the horizontal prone position that provides a desired comfort level for many users. In either the horizontal prone position or the acutely angled position, the leg support provides a support surface for the thigh area and rear surface of the leg remaining after an amputation. The support action increases the comfort level of the user, and also tends to prevent the user's amputated leg from curling toward the thigh due to contraction of the leg muscles as a result of prolonged sitting in a wheelchair without adequate leg support.

In the preferred practice of the invention an adjustment is provided for allowing the user to vary the angle of the leg support in the intermediate position. Typically the declination angle of the support leg can vary from about twenty degrees to about fifty degrees, depending on the adjustment setting.

A swingable latch plate (or support plate) is used on the seat member to co-act with an adjustable abutment member on the leg support to hold it in its intermediate position angled downwardly from the seat member. Adjustment of the abutment member adjusts the angle of the leg support.

Specific features of the invention will be apparent from the attached drawings and description of an illustrative embodiment of the invention.

DESCRIPTION OF A PREFERRED EMBODIMENT OF THE INVENTION

Figure 1:
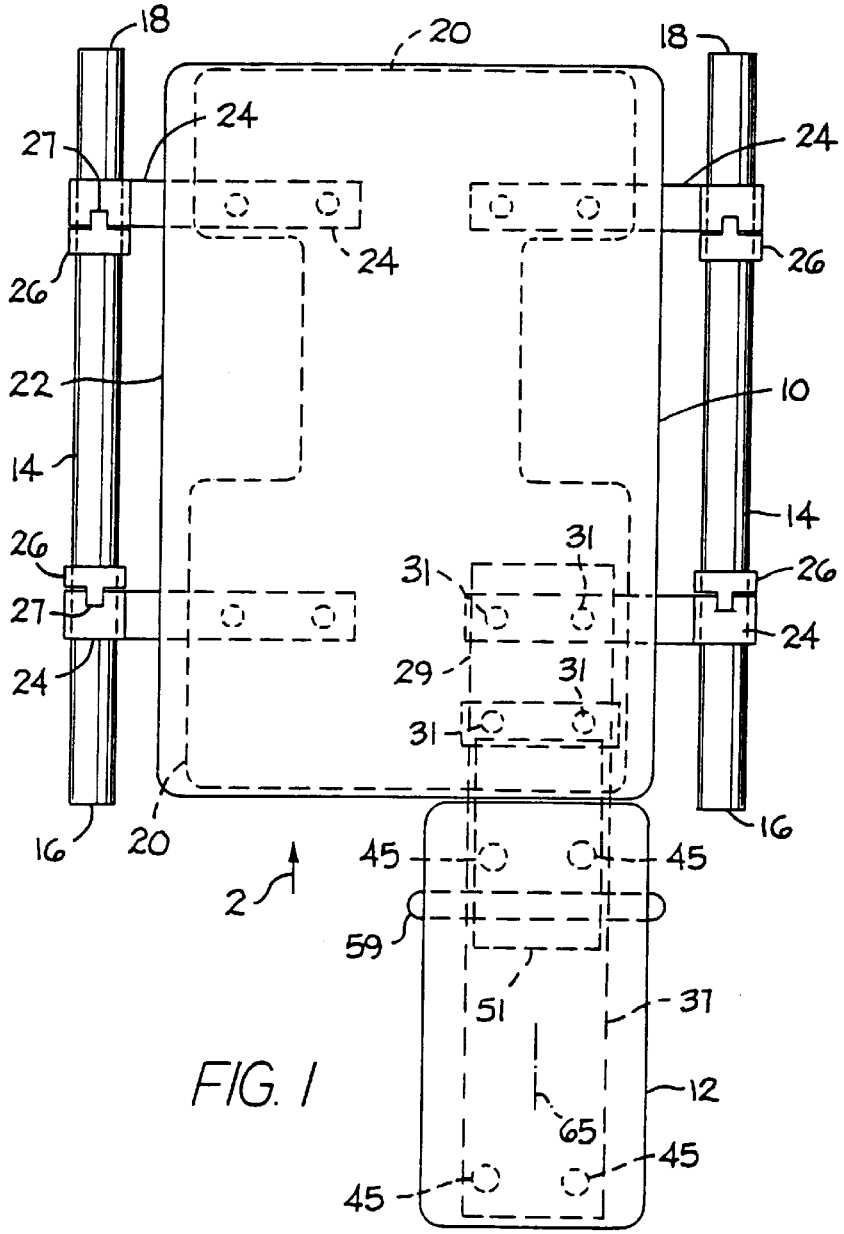
FIG. 1 is a top plan view of a wheelchair seat and leg support assembly constructed according to the invention.
Figure 2:
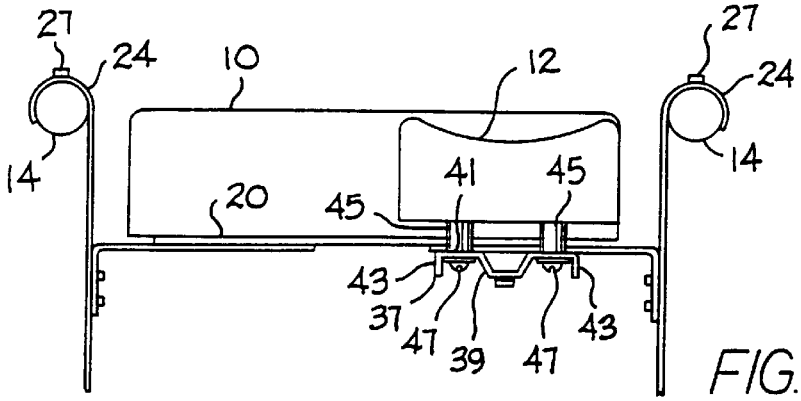
FIG. 2 is a front elevational view of the FIG. 1 assembly taken in the direction of arrow 2 in FIG. 1.

FIGS. 1 and 2, show a seat 10 and amputee leg support 12 usable on a conventional wheelchair. The wheelchair comprises two horizontal rails 14 having front ends 16 and rear ends 18. Seat 10 comprises a rigid support panel 20, preferably formed of steel or other high strength material resistant to deformation or collapse under normal loadings encountered in wheelchair seat use. A yieldable pad 22, formed for example of rubber, is positioned on support panel 20.

Seat 10 is suspended from horizontal rails 14 by four similarly constructed hangers 24. Each hanger 24 is retained against upward displacement by a slidable collar 26 that is equipped with a detent 27 adapted to overlie a curved portion of the hanger resting on rail 14. Each collar can be slidably moved along the rail to release the associated detent from the hanger.

The general relation between seat 10 and rails 14, 14 is similar to the relationship depicted in my co-pending patent application Ser. No. 858,435 filed on May 19, 1997. The rails 14, 14 form parts of a wheelchair shown in some detail in my issued U.S. Pat. No. 5,306,074 dated Apr. 26, 1994.

Figure 3:
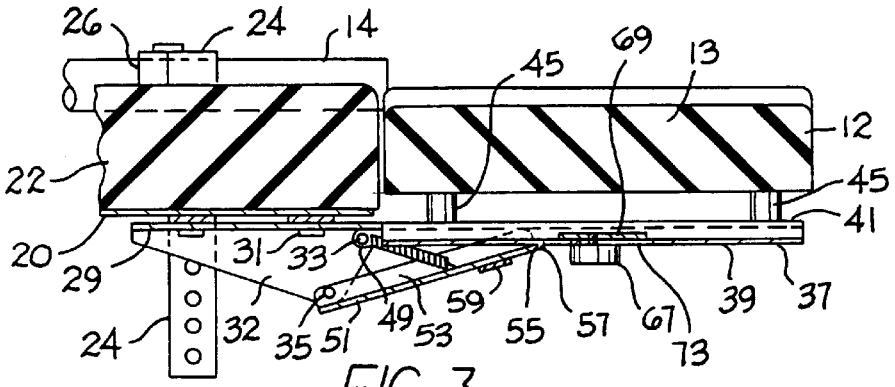
FIG. 3 is a fragmentary cross sectional view of the FIG. 1 assembly taken on line 3—3 in FIG. 1.
Figure 4:
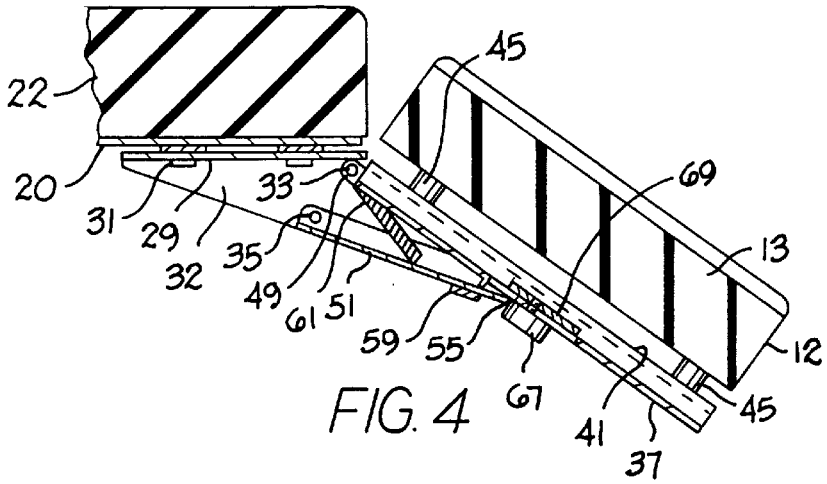
FIG. 4 is a fragmentary sectional view taken in the same direction as FIG. 3, but showing the leg support in a downwardly angled intermediate position.
Figure 5:
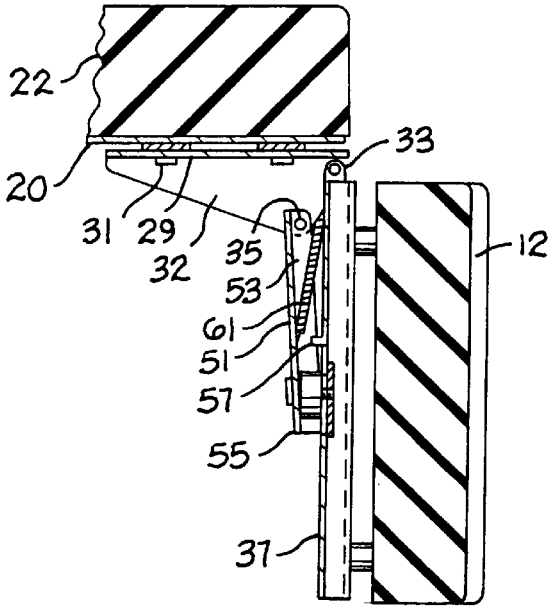
FIG. 5 is a fragmentary sectional view taken in the same direction as FIG. 3, but showing the leg support in a lowered vertical position depending from the front edge of the seat.

The present invention relates more particularly to a mechanism for hingedly attaching leg support 12 to seat 10, whereby the leg support can swing between a raised position (as shown in FIG. 3), a lowered position (as shown in FIG. 5), and an intermediate position (as shown in FIG. 4). In the raised position the leg support serves to support the upper portion of an amputated leg of the person sitting in the wheelchair. In the lowered position (FIG. 5), the leg support is retracted from the space in front of the wheelchair, whereby a person can enter or leave the wheelchair without undue difficulty. The intermediate position (FIG. 4) provides an alternate support position, wherein the person can rest the amputated leg in a declining position; such a position can offer the most comfortable condition for many wheelchair users.

As shown in FIGS. 1 through 3, the mechanism for supporting leg support 12 comprises a first bracket 29 attached to the bottom surface of seat panel 20 by threaded fasteners 31. The two rearmost fasteners also connect panel 20 to the front most hangers 24. Each fastener comprises a nut and bolt assembly of conventional construction.

Bracket 29 comprises a flat plate having downturned flanges 32 that serve as mounts for two transverse shafts 33 and 35. Flanges 32 also serve to strengthen and rigidify the flat plate. Bracket 29 is preferably formed of steel.

Hingedly attached to bracket 29 is a second bracket 37 of channel shaped cross section. As shown in FIG. 2, bracket 37 comprises a central U-shaped trough wall 39 depending from flat major wall 41, and depending flanges 43 at edge areas of the bracket. The bracket has a uniform cross section along its entire longitudinal dimension, for strength purposes.

Leg support 12 can comprise a solid rubber member 13 having four cylindrical blocks 45, preferably formed of hard rubber. End surfaces of blocks 45 abut flat wall areas 41 of bracket 37. Blocks 45 extend into deep cylindrical sockets in the surface of the rubber leg support member 13 to form high strength connections between the leg support and bracket 37. Preferably each cylindrical block 45 has an internally threaded steel insert that receives a threaded fastener 47 for attachment of the leg support to bracket 37.

Flanges 43 form ears 49 that encircle shaft 33, whereby bracket 37 is hingedly connected to bracket 29. Slots are formed in the front edge of bracket 29 to accommodate ears 49. In the raised position of leg support 12 (FIG. 3) the front edge of bracket 29 limits upward motion of bracket 37.

Figure 6:
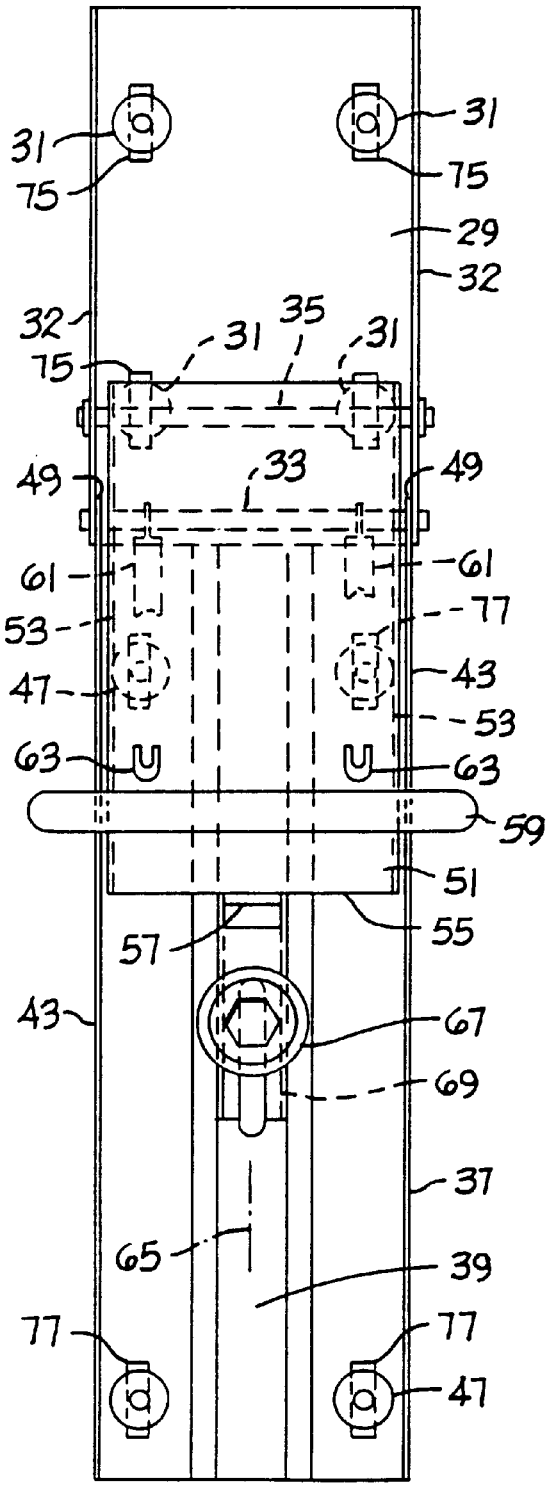
FIG. 6 is a bottom plan view of a bracket mechanism used in the FIG. 1 assembly, taken on a larger scale than FIG. 1.

Leg support 12 is supported in its raised position by a latch plate 51. The latch plate has edge flanges 53 that are apertured to pivotably mount the latch plate on shaft 35. The front edge 55 of the latch plate is adapted to engage an abutment 57 on bracket 37, whereby the latch plate supports leg support 12 in the raised position (FIG. 3) substantially coplanar with seat member 22. Plate 51 can be swung around the shaft 35 axis by a manual handle 59; as shown in FIGS. 1 and 6, handle 59 comprises an elongated bar (or strap) extending beyond plate 51 on which it is mounted.

To assist the person in lifting the leg support 12 to the FIG. 3 position, two tension coil springs 61 are trained between shaft 33 and latch plate 51. U-shaped slots 63 (FIG. 6) are formed in plate 51 to form anchors for springs 61; integral hooks on the springs attach to the plate areas circumscribed by the U-shaped slots. The springs aid in lifting leg support 12, and also keep latch plate 51 engaged with abutment 57 when the leg support is in its FIG. 3 raised position.

Abutment 57 is shown as a tab struck downwardly from trough wall 39 on the longitudinal center line 65 of bracket 37. A second abutment 67 is adjustably positioned on bracket 37 to engage the front edge of latch plate 51 for supporting the leg support 12 in the intermediate position depicted in FIG. 4.

The declination angle of leg support 12 relative to seat member 22 is shown in FIG. 4 to be approximately thirty five degrees (corresponding to the angle of bracket 37 to bracket 29). However, by adjusting the location of abutment 67 along the bracket center line 65 it is possible to vary the angle within limits. Typically, abutment 67 can be shifted along bracket 37 to vary the leg support angle from about twenty degrees to about fifty five degrees. As shown illustratively in FIG. 4, the angle is about thirty five degrees.

Abutment 67 can comprise a cylindrical hollow plug held in place on trough wall 39 by a clamping plate 69 (FIG. 7) and screw 71. The screw extends from plug 67 through a longitudinal slot 73 in wall 39 into a threaded hole in clamping plate 69. Plate 69 is elongated to have an extensive surface area in clamping engagement with trough wall 39. The width dimension of plate 69 fills the available space within trough wall 39 to prevent plate 69 from turning.

Abutment 67 can be adjusted along bracket center line 65 by loosening screw 71, changing the abutment location, and retightening the screw. If desired, the clamping screw could be integral with the plug. The adjusting process, in either case, involves rotating the screw so that its threaded shank loosens or tightens the clamping pressure of plate 69 on trough wall 39.

In the preferred practice of the invention, bracket 29 has longitudinal adjustability relative to seat panel 20, and bracket 37 has longitudinal adjustability relative to leg support 12. Such longitudinal adjustability compensates for manufacturing tolerances and also controls the spacing between the front edge of seat member 20 and the rear edge of leg support 12.

The desired longitudinal adjustments are provided by forming slot-like openings 75 in bracket 29 (for fasteners 31) and slot-like openings 77 in bracket 37 (for fasteners 47).

Figure 7:
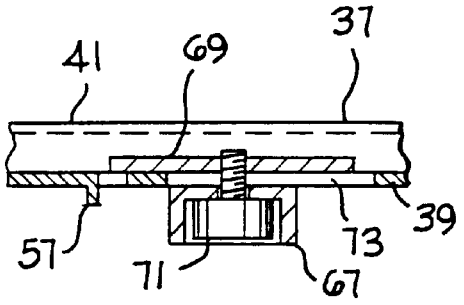
FIG. 7 is a fragmentary sectional view taken through a structural detail used in the FIG. 1 assembly.

Straps, not shown, can be used with leg support 12 to stabilize and position the amputated leg on the support surface. Such a strap is shown in FIG. 7 of the above-mentioned U.S. Pat. No. 5,306,074. The strap can readily be passed through the clearance space formed by cylindrical blocks 45 to snugly contact leg support 12.

The drawings show leg support 12 located to the left of the seat center line. However the leg support could be located to the right of the seat center line. If the wheelchair is to be used by a person having both legs amputated, two leg supports can be hingedly attached to the seat in side-by-side relationship.

Having described my invention, I claim:

1. In a wheelchair having a seat, wherein said seat has a front edge, a top surface and a bottom surface; the improvement comprising an amputee leg support having a rear edge, a top surface, and a bottom surface; a first bracket securable to the bottom surface of said seat, a second bracket securable to the bottom surface of said leg support; a hinge connection between said brackets, whereby said leg support can be swung between a raised prone position aligned with said seat and a lowered vertical position extending downwardly from said seat; and manually-operated latch means connected to said brackets for supporting said leg support in an intermediate position acutely angled downwardly relative to the seat top surface;

wherein said brackets have a common longitudinal center line; said latch means comprising a latch plate swingably attached to said first bracket, said latch plate having a front edge, a front abutment on said second bracket engageable with the front edge of said latch plate to support said leg support in its raised position, and a second abutment on said second bracket engageable with the front edge of said latch pilate to support said leg support in an intermediate position acutely angled to the seat top surface; and wherein said latch means further comprises means for adjusting said second abutment along the longitudinal center line of said second bracket, whereby the angle of the leg support relative to the seat top surface in the intermediate position can be changed to meet different user preferences.

2. The improvement in claim 1, wherein said second bracket comprises an elongated channel having a trough wall located on the bracket longitudinal center line; said trough wall having a longitudinal slot therein; said second abutment having a threaded shank extending through said slot; said adjusting means comprising a clamping plate located in the space formed by said trough wall; said threaded shank being engaged with said clamping plate, whereby the clamping plate can be clamped to said second bracket at selected positions along said longitudinal slot.

3. In a wheelchair having a seat, wherein said seat has a front edge, a top surface and a bottom surface; the improvement comprising an amputee leg support having a rear edge, a top surface, and a bottom surface; a first bracket securable to the bottom surface of said seat, a second bracket securable to the bottom surface of said leg support; a hinge connection between said brackets, whereby said leg support can be swung between a raised prone position aligned with said seat and a lowered vertical position extending downwardly from said seat; and manually-operated latch means connected to said brackets for supporting said leg support in an intermediate position acutely angled downwardly relative to the seat top surface; and wherein said first bracket has a longitudinal center line; said first bracket having adjusting means for adjusting said first bracket on the bottom surface of said seat in a direction that parallels the longitudinal center line of said first bracket.

4. The improvement of claim 3, wherein said adjusting means comprises plural adjustment openings in said first bracket, and clamping means extending through said openings for retaining said first bracket in selection positions of adjustment.

5. In a wheelchair having a seat, wherein said seat has a front edge, a top surface and a bottom surface; the improvement comprising an amputee leg support having a rear edge, a top surface, and a bottom surface; a first bracket securable to the bottom surface of said seat, a second bracket securable to the bottom surface of said leg support; a hinge connection between said brackets, whereby said leg support can be swung between a raised prone position aligned with said seat and a lowered vertical position extending downwardly from said seat; and manually-operated latch means connected to said brackets for supporting said leg support in an intermediate position acutely angled downwardly relative to the seat top surface; and wherein said second bracket has a longitudinal center line; said second bracket having an adjusting means for adjusting said second bracket on the bottom surface of said seat in a direction that parallels the longitudinal center line of said second bracket.

6. The improvement of claim 5, wherein said adjusting means comprises plural adjustment openings in said second bracket, and clamping means extending through said openings for retaining said second bracket in selected positions of adjustment.

7. In a wheelchair having a seat, wherein said seat has a front edge, a top surface and a bottom surface; the improvement comprising an amputee leg support having a rear edge, a top surface, and a bottom surface; a first bracket securable to the bottom surface of said seat, a second bracket securable to the bottom surface of said leg support; a hinge connection between said brackets, whereby said leg support can be swung between a raised prone position aligned with said seat and a lowered vertical position extending downwardly from said seat; and manually-operated latch means connected to said brackets for supporting said leg support in an intermediate position acutely angled downwardly relative to the seat top surface;

wherein said brackets have a common longitudinal center line; said latch means comprising a latch plate swingably attached to said first bracket, said latch plate having a first edge, a first abutment on said second bracket engageable with the front edge of said latch plate to support said leg support in its raised position, and a second abutment on said second bracket engageable with the front edge of said latch plate to support said leg support in an intermediate position acutely angled to the seat top surface; and wherein said second bracket comprises an elongated channel having a longitudinal center line; said elongated channel having a trough wall located on the bracket longitudinal center line; said trough wall having a longitudinal slot on the longitudinal center line; said first abutment comprising a tab struck out of said trough wall on the longitudinal center line; said second abutment comprising a plug seated on said trough wall, a clamping plate located in the space formed by said trough wall, and a clamping screw extending from said plug through said longitudinal slot into said clamping plate.

8. A s eat assembly for a wheelchair, comprising a seat, an amputee leg support, a first bracket secured to said seat, a second bracket secured to said amputee leg support, a hinge connection between said brackets whereby said leg support can be swung between a raised position aligned with said seat and a lowered position extending downwardly from said seat, and manually operated means extending from said first bracket to engage said second bracket for supporting said leg supporting in an intermediate position acutely angled downwardly relative to said seat;

wherein said manually-operated means comprises a latch plate swingably attached to said first bracket, said latch plate having a front edge, a first abutment on said second bracket engageable with the front edge of said latch plate to retain said leg support in its raised position, and a second abutment on said second bracket engageable with the front edge of said latch plate to retain said leg support in an intermediate position acutely angled to said seat; and wherein said second abutment is adjustably mounted on said second bracket so that the angle of said support plate in the intermediate position can be changed.

* * * * *

UNITED STATES PATENT AND TRADEMARK OFFICE

CERTIFICATE OF CORRECTION

PATENT NO. : 5,906,415
DATED : May 25, 1999
INVENTOR(S) : Paul Mocur

It is certified that error appears in the above-identified patent and that said Letters Patent is hereby corrected as shown below:

Column 4, line 47, change "pilat" to -- plate --.

Column 6, line 29, change "s eat" to -- seat --.

Signed and Sealed this

Second Day of May, 2000

*Attest:*

Q. TODD DICKINSON

*Attesting Officer*

*Director of Patents and Trademarks*